US005928848A

United States Patent [19]

Nair et al.

[11] Patent Number: 5,928,848

[45] Date of Patent: Jul. 27, 1999

[54] AQUEOUS COATABLE PROTECTIVE POLYETHYLENE OVERCOATS FOR IMAGING ELEMENTS

[75] Inventors: Mridula Nair, Penfield; Tamara K. Osburn; Charles H. Appell, both of Rochester, all of N.Y.

[73] Assignee: Eastman Kodak Company, Rochester, N.Y.

[21] Appl. No.: 08/980,721

[22] Filed: Dec. 1, 1997

[51] Int. Cl.[6] ..... G03C 1/85; G03C 1/89; G03C 1/825; G03C 1/76

[52] U.S. Cl. ..... 430/510; 430/527; 430/530; 430/536; 430/961

[58] Field of Search ..... 430/527, 530, 430/536, 961, 510

[56] References Cited

U.S. PATENT DOCUMENTS

| | | | |
|---|---|---|---|
| 2,627,088 | 3/1953 | Alles et al. . | |
| 2,698,235 | 3/1954 | Swindells . | |
| 2,698,240 | 12/1954 | Alles et al. . | |
| 2,943,937 | 6/1960 | Nadeau et al. . | |
| 3,143,421 | 8/1964 | Nadeau et al. . | |
| 3,201,249 | 8/1965 | Pierce et al. . | |
| 3,271,178 | 9/1966 | Nadeau et al. . | |
| 3,501,301 | 3/1970 | Nadeau et al. . | |
| 4,203,769 | 5/1980 | Guesteaux | 430/631 |
| 5,006,451 | 4/1991 | Anderson et al. | 430/527 |
| 5,147,768 | 9/1992 | Sakakibara | 430/501 |
| 5,221,598 | 6/1993 | Anderson et al. | 430/527 |
| 5,368,995 | 11/1994 | Christian et al. | 430/530 |
| 5,679,505 | 10/1997 | Tingler et al. | 430/527 |

OTHER PUBLICATIONS

"Research Disclosure", Item 36544, Sep. 1994.
"Research Disclosure", Item 38957, Sep. 1996.

*Primary Examiner*—Richard L. Schilling
*Attorney, Agent, or Firm*—Carl F. Ruoff

[57] ABSTRACT

The present invention is a photographic element including a support, having on one side thereof at least one silver halide emulsion layer, and having on the other side an antistatic layer, and a protective overcoat. The protective overcoat is farthest from the support; and is a continuous polyolefin coating.

10 Claims, No Drawings

AQUEOUS COATABLE PROTECTIVE POLYETHYLENE OVERCOATS FOR IMAGING ELEMENTS

CROSS REFERENCE TO RELATED APPLICATIONS

This application relates to commonly assigned copending application Ser. No. 08/980,728 filed simultaneously herewith and hereby incorporated by reference for all that it discloses.

FIELD OF THE INVENTION

This invention relates to a photographic element having at least one light sensitive layer on a support material and on the other side of the support material in order an antistat layer and a protective hydrophobic water impermeable overcoat wherein the overcoat is a continuous polyolefin coating derived from an aqueous dispersion of polyolefin particles.

BACKGROUND OF THE INVENTION

Motion picture photographic films that are used as print films for movie theater projection have long used a carbon black-containing layer on the backside of the film. This backside layer provides both antihalation protection and antistatic properties. The carbon black is applied in an alkali-soluble binder that allows the layer to be removed by a process that involves soaking the film in alkali solution, scrubbing the backside layer, and rinsing with water. This carbon black removal process, which takes place prior to image development, is both tedious and environmentally undesirable since large quantities of water are utilized in this film processing step. In addition, in order to facilitate removal during film processing, the carbon black-containing layer is not highly adherent to the photographic film support and may dislodge during various film manufacturing operations such as film slitting and film perforating. Carbon black debris generated during these operations may become lodged on the photographic emulsion and cause image defects during subsequent exposure and film processing.

After removal of the carbon black-containing layer the film's antistatic properties are lost. Undesired static charge build-up can then occur on processed motion picture print film when transported through projectors or on rewind equipment. Although these high static charges can discharge they cannot cause static marks on the processed photographic film. However, the high static charges can attract dirt particles to the film surface. Once on the film surface, these dirt particles can create abrasion or scratches or, if sufficiently large, the dirt particles may be seen on the projected film image.

In U.S. Pat. No. 5,679,505 herein incorporated by reference, a motion picture print film is described which contains on the backside of the support, an antistatic layer and a protective topcoat. The protective topcoat is comprised of a polyurethane binder and a lubricant. The polyurethane binder has a tensile elongation to break at least 50% and a Young's modulus measured at 2% elongation of at least 50000 $lb/in^2$.

However, post processing tar deposits and stain have been a problem with protective overcoats in motion picture print film. This tar is derived mostly from polymeric oxidized developer. The problem with most polyurethane protective overcoats is that invariably such polymers are inhomogeneous compositionally and this coupled with the fact most polyurethanes have hard and soft segments, domain structures are imparted to their coated surfaces. This can greatly increase the chances of deposition or adsorption of foreign matter to the surface.

The present invention relates to eliminating tar pickup during processing by providing a continuous polyolefin based hydrophobic overcoat that is derived from an aqueous medium resulting in a chemically homogeneous low surface energy coating resistant to tar adsorption.

Further, having the non-water permeable polyolefin overcoat of this invention, ensures protection of the underlying antistat layer from processing solutions. The low coefficient of friction that the polyolefin provides eliminates the need for an added lubricant in the top coat.

SUMMARY OF THE INVENTION

The present invention is a photographic element including a support, having on one side thereof at least one silver halide emulsion layer, and having on the other side an antistatic layer, and a protective overcoat. The protective overcoat is farthest from the support; and is a continuous polyolefin coating.

In a preferred embodiment the polyolefin is oxidized high density polyethylene.

DETAILED DESCRIPTION OF THE INVENTION

The present invention is a photographic element including a support, having on one side thereof at least one silver halide emulsion layer, and having on the other side an antistatic layer, and a protective overcoat. The protective overcoat is farthest from the support; and is a continuous polyolefin coating.

The water resistant, protective, low coefficient-of-friction topcoat on the backside of the film is effective both in maintaining the film's antistatic properties even after film processing and preventing damage to the backside of the film during the manufacture, processing, and repeated movie theater projection of the print film.

During the manufacture of a photographic film, the protective topcoat of the present invention protects the more fragile antistatic layer against abrasion or scratching which would otherwise reduce or eliminate the conductivity of the antistatic layer by reducing the antistatic layer thickness or completely breaking the continuity of the electrically-conductive, antistatic layer. During photographic processing of the photographic film, the protective topcoat is a chemical barrier between the processing solutions and the antistatic layer, thus preventing any chemical attack of the antistatic layer. During customer handling of the photographic films, in normal use conditions such as printing, transporting and projecting the photographic films, the protective topcoat must prevent abrasion damage or scratching which may either reduce or eliminate the conductivity of the antistatic layer or degrade the quality of the projected image due to projection of these scratches and abrasion marks or projection of the debris that such damage to the backing layer generates. Thus, the protective, topcoat is a critical component, in combination with the antihalation undercoat layer and the antistatic layer, for providing a motion picture print film that does not require a carbon black backing layer.

In a preferred embodiment of the present invention, the antistatic layer utilizes vanadium pentoxide as the antistatic agent. The use of vanadium pentoxide antistatic layers is well known in the literature. The preparation of an antistatic layer from a composition of vanadium pentoxide colloidal gel is described in U.S. Pat. Nos. 4,203,769, 5,006,451, 5,221,598 and 5,368,995, herein incorporated by reference. Antistatic layers containing vanadium pentoxide provide excellent protection against static charge and have the advantage of excellent transparency and their performance is not significantly dependent on ambient humidity. The excellent performance of these antistatic layers results from the particular morphology of this material. The colloidal vanadium pentoxide gel consists of entangled, high aspect ratio, flat ribbons about 50–100 angstroms wide, about 10 angstroms thick and about 1000–10,000 angstroms long. Low surface resistivities can be obtained with very low vanadium pentoxide coverage as a result of this high aspect ratio morphology. A polymer binder, such as a vinylidene chloride-containing terpolymer latex or a polyesterionomer dispersion, is preferably employed to improve the integrity of the antistatic layer and to improve adhesion to the underlying support material.

Another binder useful for antistat layers includes polyolefins as described in copending U.S. application Ser. No. 08/980,728 filed simultaneously herewith.

The antistatic layer of vanadium pentoxide is known to interact with components in the processing solutions. Frequently, the chemicals in the photographic processing solutions are capable of reacting with or solubilizing the conductive compounds in an antistatic layer, thus causing a diminution or complete loss of the desired antistatic properties. The result of this interaction is the loss of conductivity of the antistatic layer, thus the loss of dirt protection that a process surviving antistatic layer provides post-processed film. To provide protection of the antistatic layer from interacting with components of the processing solutions, a protective topcoat is applied to the antistatic layer. This protective layer chemically isolates the antistatic layer and in the case of a backside, i.e., the side opposite to the photographic emulsion layer, antistatic layer, the protective layer may also serve to provide resistance to tar and stain pickup.

The photographic film support materials used in the practice of this invention are synthetic high molecular weight polymeric materials. These support materials may be comprised of various polymeric films such as cellulose esters, cellulose triacetate, cellulose diacetate, cellulose acetate propionate, polyethylene terephthalate, polyethylene naphthalate, poly-1,4-cyclohexanedimethylene terephthalate, polybutylene terephthalate, polyimides, polyamides, polycarbonates, polystyrene, polyethylene, polypropylene, polysulfones, polyacrylates, and polyether imides, but polyester and cellulose triacetate film supports, which are well known in the art, are preferred. The thickness of the support is not critical. Support thickness of 1 to 10 mils (0.001–0.010 inches) can be employed, for example, with very satisfactory results. The polyester support typically employs an undercoat or primer layer between the antistatic layer and the polyester support to promote adhesion of the antistat layer. Such undercoat layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088, 2,698,235, 2,698,240, 2,943,937, 3,143,421, 3,201,249, 3,271,178 and 3,501,301. Film supports may optionally be surface treated by various processes including corona discharge, glow discharge, UV exposure or solvent washing in order to promote adhesion of coating compositions.

The photographic elements according to this invention can contain one or more conducting layers such as antistatic layers and/or antihalation layers such as described in Research Disclosure, Vol. 176, December 1978, Item 17643 to prevent undesirable static discharges during manufacture, exposure and processing of the photographic element. Antistatic layers conventionally used for color films have been found to be satisfactory herewith. Any of the antistatic agents set forth in U.S. Pat. No. 5,147,768 which is incorporated herein by reference may be employed. Preferred antistatic agents include metal oxides, for example tin oxide, antimony doped tin oxide and vanadium pentoxide. These antistatic agents are preferably dispersed in a film forming binder.

The antihalation undercoat used in this invention functions to prevent light from being reflected into the silver halide emulsion layer(s) and thereby causing an undesired spreading of the image which is known as halation. Any of the filter dyes known to the photographic art can be used in the present invention as a means of reducing halation. Thus, for example, water-soluble dyes can be used for this purpose. Such dyes should be incorporated in the antihalation undercoat with a mordant to prevent dye diffusion. Alternatively, and preferably, a solid particle filter dye is incorporated in the antihalation undercoat.

To promote adhesion of the antihalation underlayer to the support, primer layers as hereinabove described are advantageously employed, especially when the support is a polyester support.

In a particularly preferred embodiment, the imaging elements of this invention are photographic elements, such as photographic films, photographic papers or photographic glass plates and motion picture print films, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994 and Research Disclosure, Item 38957, September, 1996, incorporated herein by reference.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994 and Research Disclosure, Item 38957, September, 1996, and the references listed therein.

The photographic silver halide emulsions utilized in this invention can contain other addenda conventional in the photographic art. Useful addenda are described, for example, in Research Disclosure, Item 36544, September, 1994 and Research Disclosure, Item 38957, September, 1996. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form magenta dye images are phenols and naphthols. Preferred couplers which form magenta dye images are pyrazolones and pyrazolotriazoles. Preferred couplers which form yellow dye images are benzoylacetanilides and pivalylacetanilides.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Magnetic layers suitable for use in the elements in accordance with the present invention include those as described in Research Disclosure, November 1992, Item 34390, and U.S Pat. Nos. 5,395,743, 5,397,826, 5,113,903, 5,432,050, 5,434,037 and 5,436,120.

Single use camera and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The photographic processing steps to which the raw film may be subject may include, but are not limited to the following:

1.) color developing→bleach-fixing→washing/stabilizing;
2.) color developing→bleaching→fixing→washing/stabilizing;
3.) color developing→bleaching→bleach-fixing→washing/stabilizing;
4.) color developing→stopping→washing→bleaching→washing→fixing→washing/stabilizing;
5.) color developing→bleach-fixing→fixing→washing/stabilizing;
6.) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The present invention is also directed to photographic systems where the processed element may be re-introduced into the cassette. These systems allow for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The overcoat layer of the invention may be successfully applied onto unsubbed support, the subbing or undercoat layers previously described, antihalation layers containing soluble dyes or solid particle dyes, or antistatic subbing layers. In the case when the overcoat layer overlies an antistatic layer, conductive agents for use in the antistatic subbing layer include;

(1) electrically conductive metal-containing particles including donor-doped metal oxides, metal oxides containing oxygen deficiencies, and conductive nitrides, carbides, and bromides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103, 4,394, 441, 4,416,963, 4,418,141, 4,431,764, 4,495,276, 4,571,361, 4,999,276, 5,122,445 and 5,368,995.

(2) fibrous conductive powders comprising, for example, antimony-doped tin oxide coated onto non-conductive potassium titanate whiskers as described in U.S. Pat. Nos. 4,845,369 and 5,116,666 and antimony-doped tin oxide fibers or "whiskers" as described in pending U.S. Ser. No. 08/747,480 and U.S. Ser. No. 08/746,618 filed Nov. 12, 1996.

(3) the electronically-conductive polyacetylenes, polythiophenes, and polypyrroles of U.S. Pat. Nos. 4,237, 194, 5,370,981, and Japanese Patent Applications 2282245 and 2282248.

(4) the ionically-conductive cross-linked vinylbenzyl quaternary ammonium polymers of U.S. Pat. No. 4,070,189.

(5) the electronically-conductive colloidal gel of vanadium pentoxide or silver-doped vanadium pentoxide as described in U.S. Pat. Nos. 4,203,769, 5,006,451, 5,221,598 and 5,284,714, described previously.

The present invention is an overcoat or topcoat layer of polyolefin. The continuous film of polyolefin is formed by coating an aqueous dispersion of polyolefin particles which coalesce to a continuous film upon drying. The layer can be obtained from an aqueous formulation eliminating the need for using organic solvents. The low coefficient of friction that the polyolefin provides eliminates the need for an added lubricant in the top coat. The layer is impermeable to aqueous solutions and thus protects the underlying layers such as antistat layers that are sensitive to processing solutions. The overcoat shows improved resistance to tar and stain pickup compared to the polyurethane overcoats described in U.S. Pat. No. 5,679,505. The polyolefin has excellent adhesion to the various substrates such as subbed polyethylene terephthalate substrate. Being an aqueous solution, additives compatible with aqueous solutions may be added to the polyolefin dispersion prior to coating, additives such as fillers, matte particles etc. For example, the polyethylene overcoat may additionally contain additives such as fillers for improving the modulus of the layer, polymer or other particles for modifying its ferrotyping characteristics, optimizing the coefficient-of-friction of the coating, etc.

The water dispersible polyolefin overcoat described herein provides a continuous film with good resistance to process tar and stain pickup, excellent adhesion to the support, excellent conductivity, low coefficient of friction and water impermeability. The materials useful in this invention include those derived from aqueous dispersions of polyethylene, polypropylene, polybutylene etc., and their copolymers including such resins that have been modified with hydroxyl groups, carboxyl groups, amino groups, amido groups, or other functional groups, including urethane, isocyanate etc. Of these resins, oxidized high density polyethylene is preferred.

The aqueous polyolefin dispersions of the present invention contain polyolefin particles smaller than 1 micron, preferably less than 0.5 microns. The polyolefins preferably have a melting point below 150° C.

The preferred dried coating thickness is greater than 100 $mg/m^2$ and more preferable >275 $mg/m^2$ and most preferably >500 $mg/m^2$.

Polyolefin dispersions of the kind described above are available commercially for example under the trade names Poly Emulsion, Chemcor Emulsion etc., from Chemical Corporation of America. Similar dispersions are also available from Michelman Inc., Allied Chemical etc.

Other additional compounds that can be employed in the overcoat or topcoat layer compositions of the invention include surfactants, coating aids, coalescing aids, dyes, biocides, UV and thermal stabilizers, magnetic recording particles, and other addenda well known in the imaging art.

The overcoat layer compositions of the present invention may be applied at up to 20% total solids by coating methods well known in the art. For example, hopper coating, gravure coating, skim pan/air knife coating, spray coating, and other methods may be used with very satisfactory results. The coatings are dried at temperatures up to 150° C.

The following examples are used to illustrate the present invention. However, it should be understood that the invention is not limited to these illustrative examples.

EXAMPLE 1

A subbed polyester support was prepared by first applying a subbing terpolymer of acrylonitrile, vinylidene chloride and acrylic acid to both sides of the support before drafting and tentering so that the final coating weight was about 90 $mg/m^2$. An aqueous dispersion of oxidized high density polyethylene Chem Corr Emulsion 260 (CCE 260, Chemical Corporation of America) was coated as a 2% by weight solids on the subbed polyethylene terephthalate to a dry coating thickness of 270 $mg/m^2$.

Tar Test: A simulated developer tar test was performed on the samples to determine their propensity for tar/stain build-up. The test was done at a 105° F. and involved smearing tar harvested from a developer tank onto the coating in a developer bath followed by removal of the tar using dilute sulfuric acid. The resultant stain is indicative of the propensity of the coating for tar pickup. The coating showed very good resistance to tar.

Adhesion Test: The coating also showed excellent dry and wet adhesion to the substrate. The dry adhesion was measured by scribing a small crosshatched region into the coating with a razor blade, placing a piece of high tack adhesive tape over the scribed area and then quickly stripping the tape from the surface. The relative amount of material removed from the scribed area is a qualitative measure of dry adhesion. The wet adhesion was measured by scribing a one millimeter wide line in the coating, placing the test sample in developing solution at 37.5° C. and rubbing across the scribe line in circular motions with a roughened rubber pad. The integrity of the area after rubbing is compared to that before rubbing to give a measure of wet adhesion. The test performed showed no removal of the overcoat.

The coefficient of friction of coating was 0.14.

EXAMPLE 2

An antistatic formulation consisting of the following components was prepared at 0.078% total solids:

| | |
|---|---|
| A terpolymer of acrylonitrile, vinylidene chloride and acrylic acid, 30% | 0.094% |
| Vanadium pentoxide colloidal dispersion, 0.57% | 4.972% |
| Rohm & Haas surfactant, Triton X-100, 10% | 0.212% |
| Demineralized water | 94.722% |

The antistatic formulation was coated over the subbed polyester support, described in Example 1, on one side to give a dry coating weight of about 12 mg/m$^2$.

Then, a protective overcoat formulation was used to overcoat the antistatic layer. The protective overcoat contained the following components:

| | dry coverage mg/m$^2$ |
|---|---|
| Polyethylene (CCE 260) | 1030 |
| Matte beads, 1.47 um polymethyl methacrylate, | 34.4 |
| Rohm & Haas surfactant, Triton X-100 | 11.8 |

Internal resistivity (WER) of the overcoated antistatic layer measured by the salt bridge method was 8.1 log Ω/square. To simulate the processing solutions, the sample was immersed in a pH 10 buffer for 15 minutes. WER after the pH 10 treatment was 7.8 log Ω/square.

Without the overcoat there is no measurable conductivity after the pH 10 soak.

The tar test was performed as in Example 1. The results showed that, while the comparative Example 3 picked up a significant amount of tar, the sample from Example 2 showed no noticeable tar adhesion to the film.

The wet adhesion as measured in Example 1 by the wet abrasion test in a developer solution was excellent.

The dry adhesion as measured in Example 1 was excellent.

The coefficient of friction of coating was 0.11.

EXAMPLE 3 (Comparative)

Another comparative protective topcoat formulation was used to overcoat the antistatic layer described in Example 2. This protective topcoat consisted of the following components:

| | dry coverage mg/m2 |
|---|---|
| Polyurethane (Witco Bond W232, Witco Corp.) | 1215 |
| Matte, polymethyl methacrylate beads, 1.47 μm | 34.4 |
| Wax lubricant | 0.64 |
| Polyfunctional aziridine crosslinker | 74.3 |
| Rohm & Haas surfactant, Triton X-100 | 9.7 |

This coating was subjected to the tar test as described in previously. The coating showed a significant amount of tar stain.

EXAMPLE 4

A conductive tin oxide/polyethylene formulation was coated on Estar subbed as in Example 1 such that the coating had a dry coverage of 377 mg/m$^2$ of antimony doped tin oxide oxide (DuPont, 3010) and a tin oxide to binder weight ratio of 75:25. The surface resistivity measured was 7.6 log Ω/square. The wet adhesion and the dry adhesion as measured in Example 1 were excellent and showed no removal of material.

EXAMPLE 5

The coating from Example 4 was overcoated with 270 mg/m$^2$ polyethylene. The surface resistivity of the coating was 8.4 and the internal resistivity was 7.95.

The tar as described in Example 1 showed no noticeable tar adhesion to the film.

The wet adhesion and the dry adhesion as measured in Example 1 were excellent and showed no removal of material.

The coefficient of friction of coating was 0.14.

The invention has been described in detail with particular reference to certain preferred embodiments thereof, but it will be understood that variations and modifications can be effected within the spirit and scope of the invention.

What is claimed is:

1. A photographic element comprising a support, having on a first side thereof at least one silver halide emulsion layer, and having on a second side an antistatic layer, and overlying the antistatic layer a protective overcoat farthest from said support; said protective overcoat comprising a continuous polyolefin coating.

2. The photographic element of claim 1 wherein said support is selected from the group consisting of cellulose esters, cellulose triacetate, cellulose diacetate, cellulose acetate propionate, polyethylene terephthalate, polyethylene naphthalate, poly-1,4-cyclohexanedimethylene terephthalate, polybutylene terephthalate, polyimides, polyamides, polycarbonates, polystyrene, polyethylene, polypropylene, polysulfones, polyacrylates, and polyether imides.

3. The photographic element of claim 1 wherein the antistatic layer comprises an antistatic agent selected from the group consisting of electrically conductive metal-containing particles, donor-doped metal oxides, metal oxides containing oxygen deficiencies, conductive nitrides, conductive carbides, conductive borides, semiconductive metal salts, fibrous conductive powders, and conductive polymers.

4. The photographic element of claim 1 further comprising a magnetic recording layer superposed on the first or second side of the support.

5. The photographic element of claim 1 further comprising spacer layers, filter layers, interlayers, antihalation layers, pH lowering layers, timing layers, opaque reflecting layers, or opaque light-absorbing layers superposed on the first or second side of the support.

6. The photographic element of claim 1 wherein the polyolefin coating comprises an aqueous dispersion of polyethylene, polypropylene, polybutylene, copolymers of polyethylene, copolymers of polypropylene, or copolymers of polybutylene.

7. The photographic element of claim 6 wherein the aqueous dispersions comprise polyolefin particles smaller than 1 micron, preferably less than 0.5 microns.

8. The photographic element of claim 1 wherein the polyolefin binder has a melting point below 150° C.

9. The photographic element of claim 1 wherein said overcoat further comprises fillers, matte particles, surfactants, coating aids, coalescing aids, dyes, UV stabilizers, or thermal stabilizers.

10. The photographic element of claim 1 wherein said overcoat has dried thickness of greater than 100 $mg/m^2$.

* * * * *